US005382935A

United States Patent [19]

Doyelle

[11] Patent Number: 5,382,935

[45] Date of Patent: Jan. 17, 1995

[54] PERMANENT-MAGNET GRAB

[75] Inventor: Pierre Doyelle, Montmelian, France

[73] Assignee: Braillon Magnetique, Montmelian, France

[21] Appl. No.: 261,349

[22] Filed: Jun. 16, 1994

[30] Foreign Application Priority Data

Jun. 24, 1993 [FR] France ..... 93 07940

[51] Int. Cl.[6] ..... H01F 7/02; H01F 7/04; B66C 1/04

[52] U.S. Cl. ..... 335/288; 335/295

[58] Field of Search ..... 335/285-295; 269/8; 294/65.5, 88

[56] References Cited

U.S. PATENT DOCUMENTS

| | | | |
|---|---|---|---|
| 4,314,219 | 2/1982 | Haraguchi | 335/295 |
| 4,465,993 | 8/1984 | Braillon | 335/287 |
| 5,166,654 | 11/1992 | Doyelle | 335/288 |

FOREIGN PATENT DOCUMENTS

| | | |
|---|---|---|
| 2704118 | 1/1977 | Germany . |
| 0090746 | 5/1983 | Germany . |

*Primary Examiner*—Leo P. Picard
*Assistant Examiner*—Raymond M. Barrera
*Attorney, Agent, or Firm*—Herbert Dubno; Andrew Wilford

[57] ABSTRACT

A magnetic grab has a pair of vertically elongated magnetic pole pieces each having an upper end and a lower end. The pole pieces diverge downward symmetrically with respect to a vertical symmetry plane with the upper ends substantially more closely spaced than the lower ends. A plurality of nonmagnetic elements fixed to the pole pieces secure same together and a generally cylindrical rotor engaged between the pole pieces and centered on and rotatable about a rotor axis extending horizontally parallel to and between the pole pieces is formed by a pair of soft-iron bodies one of which is substantially thicker in a direction transverse to the axis than the other. One or more permanent magnets are sandwiched between the bodies and polarized generally diametrically of the rotor axis. The rotor can be turned between an active position with one of the bodies juxtaposed with one of the pole pieces and the other body juxtaposed with the other pole piece and one of the bodies lying mainly to one side of the plane and the other body lying mainly to the other side of the plane and an inactive position with the plane generally bisecting both bodies and each body closely juxtaposed with both pole pieces.

10 Claims, 2 Drawing Sheets

PERMANENT-MAGNET GRAB

FIELD OF THE INVENTION

The present invention relates to a grab. More particularly this invention concerns a switchable permanent-magnet grab.

BACKGROUND OF THE INVENTION

A standard magnetic grab such as described in French patent document 2,441,577, German patent document 2,704,118 and European patent application 90,746 normally has two groups of permanent magnets each having a lower surface sitting atop a respective pole piece and an upper surface bridged by a piece of mild steel, forming in effect a downwardly pointing U-magnet. The magnets in one leg are polarized oppositely to those in the other leg so that one of the pole pieces is the north pole and the other the south pole of the magnet. A rotor situated between the legs of this symmetrical magnet can be rotated to juxtapose its north pole with the north-pole leg and its south pole with the south-pole leg in an active position to add together the magnetic fields and to make the grab capable of lifting a magnetically attractable object engaged with the pole pieces. When reversed, with the rotor north pole turned toward the south-pole leg and the rotor south pole turned toward the north-pole leg, all flux flows between the two legs through the rotor and the grab has no appreciable lifting capacity.

It has been suggested in U.S. Pat. No. 5,166,654 to use a pair of pole pieces each forming a downwardly directed pole and formed adjacent the respective poles with horizontally extending semicylindrical seats having approximately the same center of curvature and open concavely inward toward each other. One of the pieces has an upwardly directed upper surface to one side of the seats and the other piece has a lower surface directed downward at the upper surface and also to the one side of the seats. A rotor fitting in the seats is provided with a plurality of high-flux rotor magnets polarized about respective axes extending generally diametrically of the rotor axis. At least one low-flux permanent magnet having a vertical polarization axis between the upper and lower surfaces has its north pole engaging one of the surfaces and its south pole engaging the other surface. The rotor can be turned about its axis between an active position with the north poles of the rotor magnets turned toward the seat of the piece having the other surface and the south poles of the rotor magnets turned toward the seat of the piece having the one surface, and an inactive position with the north poles of the rotor magnets turned toward the seat of the piece having the one surface and the south poles of the rotor magnets turned toward the seat of the piece having the other surface.

Furthermore U.S. Pat. No. 4,465,993 has a pair of vertical and parallel pole plates between which is provided a cylindrical rotor that is rotatable to establish the active and inactive positions.

All these arrangements are fairly tall so that they have a high center of gravity and therefore can be fairly difficult to use. In addition they have a fairly small footprint so that lifting a large object with them requires that they be carefully centered on the object.

With today's powerful rare-earth permanent magnets it should in theory be possible to make a grab that is more powerful and lighter than the prior-art systems.

Ideally such a grab would not need several sets of magnets. Nonetheless such an arrangement has not been made that constitutes a large improvement on the prior-art systems.

OBJECTS OF THE INVENTION

It is therefore an object of the present invention to provide an improved permanent-magnet grab.

Another object is the provision of such an improved permanent-magnet grab which overcomes the above-given disadvantages, that is which is relatively short and which exploits the more powerful rare-earth magnets now available.

SUMMARY OF THE INVENTION

A magnetic grab has according to the invention a pair of vertically elongated magnetic pole pieces each having an upper end and a lower end. The pole pieces diverge downward symmetrically with respect to a vertical symmetry plane with the upper ends substantially more closely spaced than the lower ends. A plurality of nonmagnetic elements fixed to the pole pieces secure same together and a generally cylindrical rotor engaged between the pole pieces and centered on and rotatable about a rotor axis extending horizontally parallel to and between the pole pieces is formed by a pair of soft-iron bodies one of which is substantially thicker in a direction transverse to the axis than the other. One or more permanent magnets are sandwiched between the bodies and polarized generally diametrically of the rotor axis. The rotor can be turned between an active position with one of the bodies juxtaposed with one of the pole pieces and the other body juxtaposed with the other pole piece and one of the bodies lying mainly to one side of the plane and the other body lying mainly to the other side of the plane and an inactive position with the plane generally bisecting both bodies and each body closely juxtaposed with both pole pieces.

The asymmetry of the rotor thus makes it possible to increase the footprint of the device or the area of its lower workpiece-engaging surface. As a result relatively large objects can be grabbed and raised. The hold will be excellent so that even if the lifting equipment, typically a crane connected to an eye on the grab, stops and starts suddenly, the workpiece being lifted will not be released.

According to invention the nonmagnetic elements include a relatively narrow and generally horizontal top plate fixed to and bridging the upper ends of the pole pieces, and a relatively wide and generally horizontal bottom plate fixed to and bridging the lower ends of the pole pieces. In addition a pair of upright end plates are fixed to the pole pieces and top and bottom plates. The rotor is journaled in the end plates.

The bodies according to the invention are part cylindrical and each have a part-cylindrical outer surface and a planar inner surface. The inner surfaces are parallel to and confront each other. The magnets are of the rare-earth type, preferably of the neodymium-iron-boron type.

The rotating system includes a handle projecting radially from and fixed angularly to the rotor, and a detent including a displaceable element on the handle and a seat fixed relative to the pole pieces and in which the element is engageable in the active position. The end plate is formed with the seat and the pole pieces are soft-iron plates.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
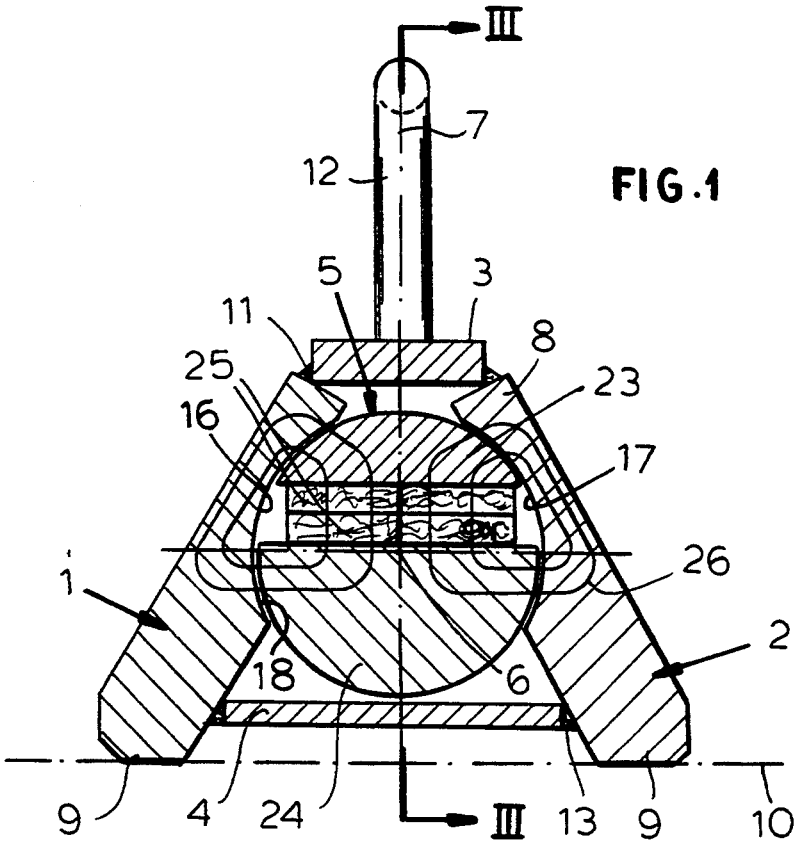
FIG. 1 is a vertical cross section through the grab of this invention in the inactive position.
Figure 2:
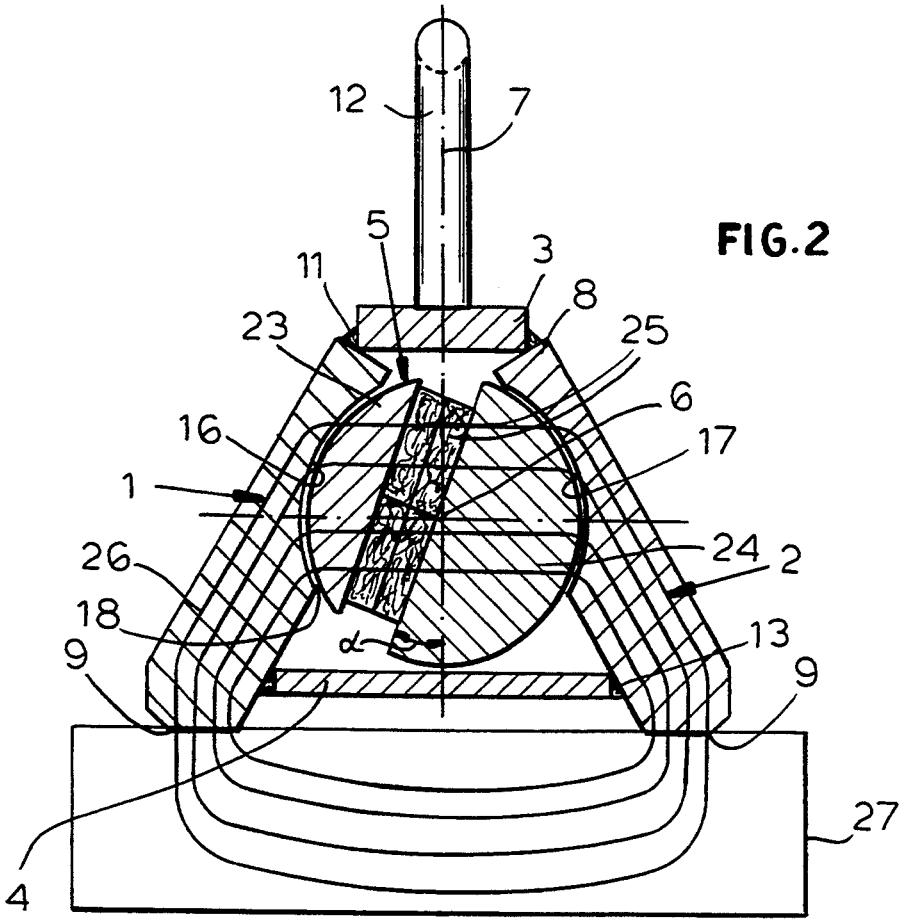
FIG. 2 is a view like FIG. 1 but with the grab in the active or lifting position.
Figure 3:
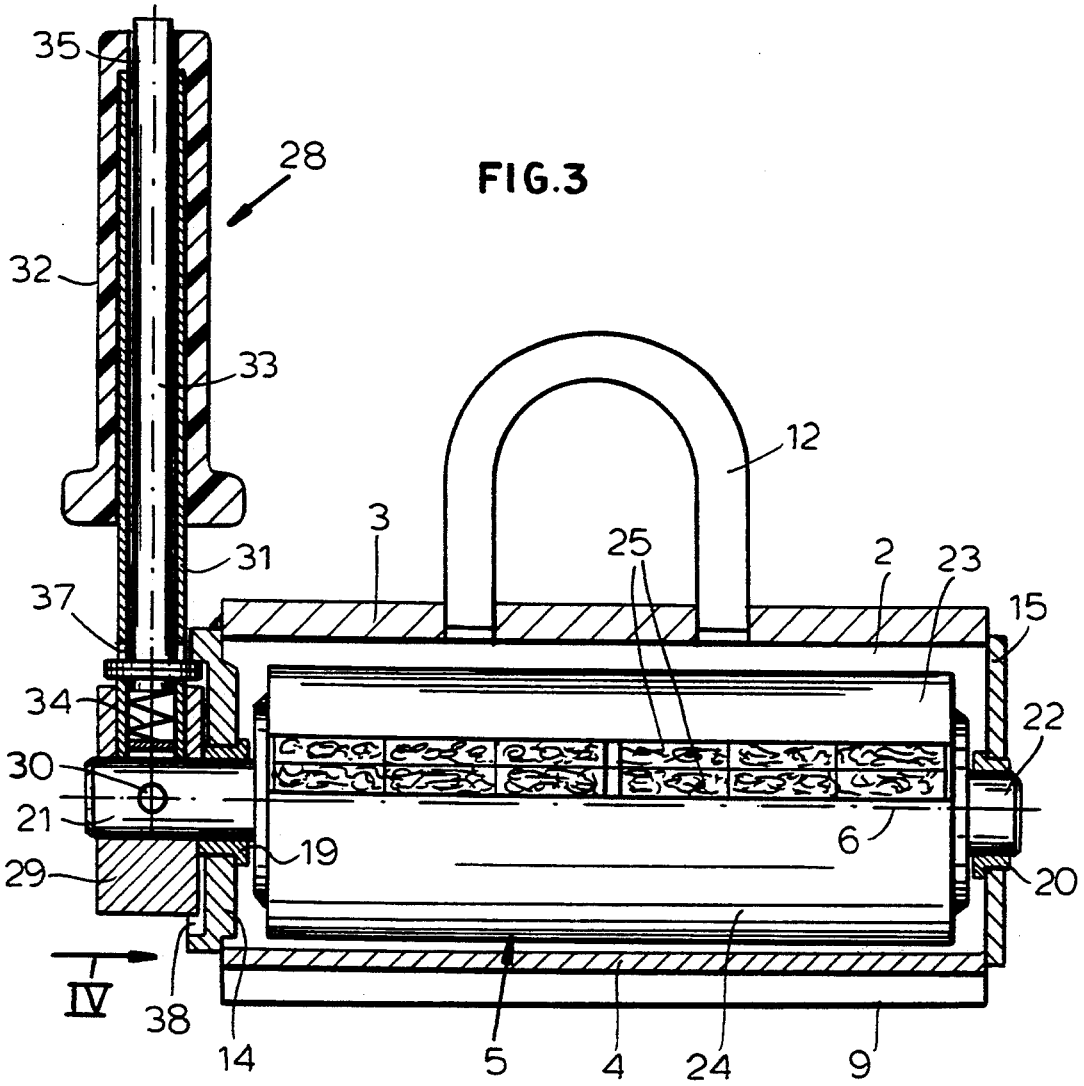
FIG. 3 is a section taken along line III—III of FIG. 1.

As seen in FIGS. 1 to 3 the grab according to this invention has a pair of soft-iron plates forming pole pieces 1 and 2 and two stainless-steel connecting plates 3 and 4 surrounding a rotor 5 rotatable about a normally horizontal axis 6. The pole pieces 1 and 2 symmetrically flank an upright symmetry plane 7 that bisects the horizontal connecting plates 3 and 4 and passes through the axis 7. The pieces 1 and 2 have relatively closely spaced upper ends 8 and relatively widely spaced lower ends 9 terminating at a horizontal pickup plane 10 perpendicular to the plane 7 so that the assembly has the shape seen from the end of an isosceles trapezoid with an apex angle of about 60°, that is with each piece 1 and 2 forming an angle of 30° with the plane 7. A pickup ring 12 is centrally attached to the top connecting plate 3 and lies on the plane 7. The top plate 3 is connected to the upper ends 8 at welds 11 and the plate 4 to the lower ends at welds 13, with this plate 4 extending parallel to the plane 10 but somewhat above it. The ends of the assembly are closed by further stainless-steel connecting plates 14 and 15 welded to all of the parts 1 through 4 and extending parallel to each other and perpendicular to the axis 6.

The pole pieces 1 and 2 are formed with respective part-cylindrical seats 16 and 17 whose centers of curvature are the axis 7 and that form a small gap 18 with the cylindrical outer surface of the rotor 5. As best seem in FIG. 3 the end connecting plates 14 and 15 have nonmagnetic journals 19 and 20 centered on the axis 6 and receiving respective gudgeons or pivot pins 21 and 22 fixed on the rotor 5, permitting the rotor 5 to rotate freely about the axis 6.

The rotor 5 itself is formed of two part-cylindrical soft-iron bodies 23 and 24 sandwiching an array 25 of permanent magnets. The body 24 is substantially larger than the body 23 so that in fact it constitutes more than a semicylinder and the axis 6 lies within the body 24 beneath its planar inner face. Thus the body 24 is substantially thicker, measured radially of the axis 6 and perpendicular to its planar inner face than the body 24 measured in the same way. The magnets 25 are oriented so that their lines of force 26 are perpendicular to the confronting inner faces of the bodies 23 and 24 they are sandwiched between.

Thus according to the invention when the rotor 5 is oriented with the plane 7 bisecting both rotor bodies 23 and 24 as shown in FIG. 1 the lines of force 26 run wholly through the plates 1 and 2, remaining in the assembly. This is the inactive position in which a magnetically attractable object applied to the ends 9 at the plane 10 will not be attracted.

When, however, as shown in FIG. 2 the rotor 5 is turned so that the planar faces of the pieces 23 and 24 form at most a angle $\alpha$ with the plane 7 and neither of these pieces 23 and 24 is directly juxtaposed with both pieces 1 and 2, the lines of force will flow down one of the pieces 1 or 2, across the gap at the ends 9, and up the other pieces 1 or 2. Thus a magnetically attractable object 27 engaged against the ends 9 at the plane 10 will close the magnetic circuit and be attracted strongly to the grab.

Figure 4:
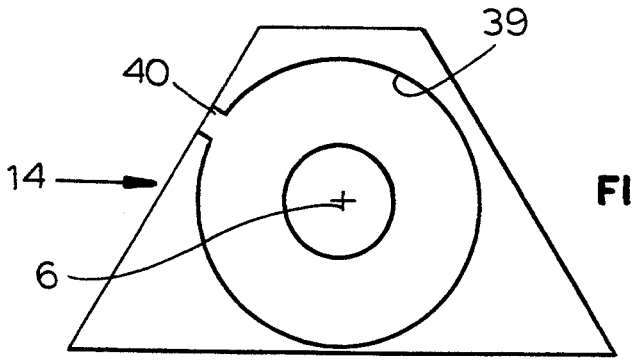
FIG. 4 is an end view of the end plate taken in the direction of arrow IV of FIG. 3.

In order to switch between the two modes an assembly 28 is provided comprising a hub 29 secured by a crosswise pin 30 to the gudgeon 21 and supporting a tube 31 carrying a handle 32 and housing a radially displaceable rod 33. A spring 34 urges the rod 33 radially outward so its outer end 35 projects past the tube 31 and handle 32. The inner end of this rod 33 is provided with a crosswise pin 36 whose ends project through two slots 37 formed in the tube 31. One end of the pin 36 rides in a guide groove 38 formed in the plate 14 and can ride as shown in FIG. 4 on an inside surface 39 and engage in a radially inwardly open seat or notch 40 in the active (FIG. 2) position.

Thus when the grab is in the active position, it can be switched to the inactive position by depressing the button end 35 and swinging the handle 32 through substantially less than 90°. For movement from the inactive to the active position the button 35 does not need to be actuated, as no harm can normally be done by this action.

I claim:

1. A magnetic grab comprising:

a pair of vertically elongated magnetic pole pieces each having an upper end and a lower end, the pole pieces diverging downwardly symmetrically with respect to a vertical symmetry plane with the upper ends substantially more closely spaced than the lower ends;

a plurality of nonmagnetic elements fixed to the pole pieces and securing same together;

a generally cylindrical rotor engaged between the pole pieces, centered on and rotatable about a rotor axis extending horizontally parallel to and between the pole pieces, and formed by a pair of soft-iron bodies one of which is substantially thicker in a direction transverse to the rotor axis than the other, and a permanent magnet sandwiched between the bodies and polarized generally diametrically of the rotor axis; and means for rotating the rotor between an active position with one of the bodies juxtaposed with one of the pole pieces and the other body juxtaposed with the other pole piece and one of the bodies lying mainly to one side of the plane and the other body lying mainly to the other side of the plane, and an inactive position with the plane generally bisecting both bodies and each body closely juxtaposed with both pole pieces.

2. The permanent-magnet grab defined in claim 1 wherein the nonmagnetic elements include a relatively narrow and generally horizontal top plate fixed to and bridging the upper ends of the pole pieces, and a relatively wide and generally horizontal bottom plate fixed to and bridging the lower ends of the pole pieces.

3. The permanent-magnet grab defined in claim 2 wherein the nonmagnetic elements further include a pair of upright end plates fixed to the pole pieces and top and bottom plates, the rotor being journaled in the end plates.

4. The permanent-magnet grab defined in claim 1 wherein the bodies are part cylindrical and each have a part-cylindrical outer surface and a planar inner surface, the inner surfaces being parallel to and confronting each other.

5. The permanent-magnet grab defined in claim 1 wherein the magnets are of the rare-earth type.

6. The permanent-magnet grab defined in claim 5 wherein the magnets are of the neodymium-iron-boron type.

7. The permanent-magnet grab defined in claim 1 wherein the means for rotating includes a handle projecting radially from and fixed angularly to the rotor, and detent means including a displaceable element on the handle and a seat fixed relative to the pole pieces and in which the element is engageable in the active position.

8. The permanent-magnet grab defined in claim 7 wherein the nonmagnetic elements include an end plate formed with the seat.

9. The permanent-magnet grab defined in claim 1 wherein the pole pieces are soft-iron plates.

10. A magnetic grab comprising:

a pair of vertically elongated magnetic pole plates each having an upper end and a lower end, the pole plates diverging downwardly symmetrically with respect to a vertical symmetry plane with the upper ends spaced apart but substantially more closely spaced than the lower ends;

a relatively narrow and generally horizontal top plate fixed to and bridging the upper ends of the pole plates;

a relatively wide and generally horizontal bottom plate fixed to and bridging the lower ends of the pole plates;

a pair of upright end plates fixed to the pole plates and top and bottom plates;

a generally cylindrical rotor engaged between the pole plates and journaled in and between the end plates, centered on and rotatable about a rotor axis extending horizontally parallel to and between the pole plates, and formed by a pair of part-cylindrical soft-iron bodies one of which is substantially thicker in a direction transverse to the rotor axis than the other, and a permanent magnet sandwiched between the bodies and polarized generally diametrically of the rotor axis; and means for rotating the rotor between an active position with one of the bodies juxtaposed with one of the pole plates and the other body juxtaposed with the other pole plate and one of the bodies lying mainly to one side of the plane and the other body lying mainly to the other side of the plane, and an inactive position with the plane generally bisecting both bodies and each body closely juxtaposed with both pole plates.

* * * * *